United States Patent [19]

Miller

[11] 4,444,233

[45] Apr. 24, 1984

[54] KNIFE HOLDER IN WOODWORKING MACHINE

[75] Inventor: Fred L. B. Miller, Lake Oswego, Oreg.

[73] Assignee: Dorothy W. Miller, Lake Oswego, Oreg.

[21] Appl. No.: 378,498

[22] Filed: May 17, 1982

[51] Int. Cl.[3] ..... B27G 13/04

[52] U.S. Cl. ..... 144/220; 144/162 R

[58] Field of Search ..... 407/73, 75, 77, 79, 407/85, 87, 95, 94, 108; 308/3 A; 144/220, 218, 230

[56] References Cited

U.S. PATENT DOCUMENTS

| | | | |
|---|---|---|---|
| 2,195,841 | 4/1940 | Schlitters | 308/3 A |
| 2,920,896 | 1/1960 | Buck | 308/3 A |
| 3,777,793 | 12/1973 | Miller | 144/220 |
| 4,082,127 | 4/1978 | Miller | 144/220 |

*Primary Examiner*—W. D. Bray
*Assistant Examiner*—Jorji M. Griffin
*Attorney, Agent, or Firm*—Lee R. Schermerhorn

[57] ABSTRACT

A knife is secured in a holder by a cambered clamp plate which is flattened against one face of the knife by a pair of sliding wedges engaging opposite side edge portions of the clamp plate. The wedges are tightened individually to facilitate accurate positioning of the clamp plate and proper seating of the knife for producing a smooth surface on the underlying wood.

1 Claim, 8 Drawing Figures

KNIFE HOLDER IN WOODWORKING MACHINE

BACKGROUND OF THE INVENTION

This invention relates to an improved knife holder in a woodworking machine such as, but not limited to, a log slabbing chipper or edger.

The present knife holder is an improvement over that illustrated and described in my prior U.S. Pat. No. 3,777,793. The single tightening screw in said patent does not always pull the clamp plate into the holder in a manner which will maintain its proper position against the knife. This often permits the knife to work loose resulting in a poor board surface and wood buildup between the knife and clamp plate. This condition is most pronounced after the part has been in service and has developed minor distortion resulting from stress relief. The only cure for this problem is removal and resetting of the adjusting wedges, which is a relatively tedious procedure requiring welding. This procedure is required also when the clamp plates are replaced because of wear or damage.

Because of the relatively shallow taper in the adjusting wedges, unusual impact on the nosing of the clamp plate will drive it into the holder so tightly that it is difficult to loosen for removal of the knife.

Also, the backing bar assembly in said prior patent does not provide for setting the knife quickly. The knife, clamp plate and backing bar assembly must be removed in order to add or replace special shims for making this setting.

SUMMARY OF THE INVENTION

In the present construction the improved type of clamping action utilizes two screws which engage a pair of sliding wedges and which in turn wedge a previously positioned clamp plate into contact with the knife. The clamp plate is cambered as described in said patent. A particular tightening sequence will be described for obtaining optimum results from the arrangement. The provision of two sliding wedges when tightened permits the proper seating of the clamp plate every time they are tightened. This advantage improves the positioning of the knife and related smoothness of the board surface produced by the knives.

The backing bar comprises two sections and screws so that one section can be jacked forward or retracted as required for the setting of the knife. This procedure will be described in detail.

The invention will be better understood and additional objects and advantages will become apparent from the following description of the preferred embodiment illustrated in the accompanying drawings. Various changes may be made however in details of construction and arrangement of parts and certain features may be used without others. All such modifications within the scope of the appended claims are included in the invention.

DESCRIPTION OF THE PREFERRED EMBODIMENT

Figure 1:
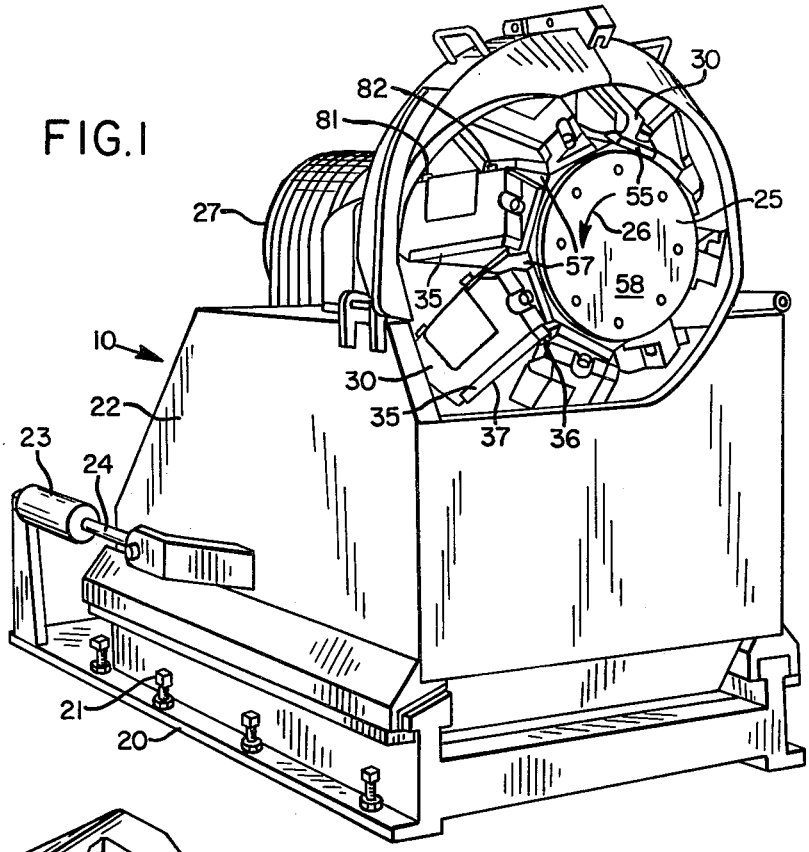
FIG. 1 is a perspective view of a chipper machine embodying the invention.

In FIG. 1 chipper machine 10 comprises a base frame 20 rigidly secured to a floor or heavy foundation by bolts 21. The frame 22 of the chipper machine is mounted for sliding movement on base 20 and is adjustable toward and away from the side of a log by hydraulic cylinders 23 and piston rods 24 connected between base 20 and frame 22 on opposite sides of the machine.

Figure 2:
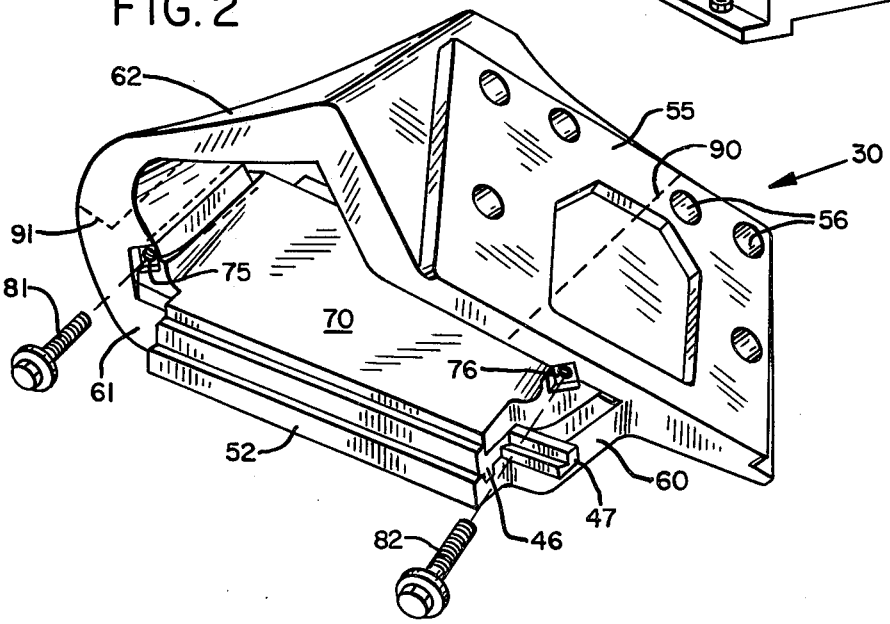
FIG. 2 is a perspective view of a knife holder in FIG. 1.

Mounted on the movable frame 22 is a rotor head 25 rotatable on a horizontal axis and driven in the direction of arrow 26 by driven pulley 27. Pulley 27 is belted to a motor in the frame 22. Mounted on rotor head 25 is a plurality of knife holders 30 which incorporate important features of the present invention. Knife holders 30 carry chipper knifes arranged to plane a flat surface on one side of a log as illustrated in FIGS. 1 and 2 in said U.S. Pat. No. 3,777,793.

Figure 8:
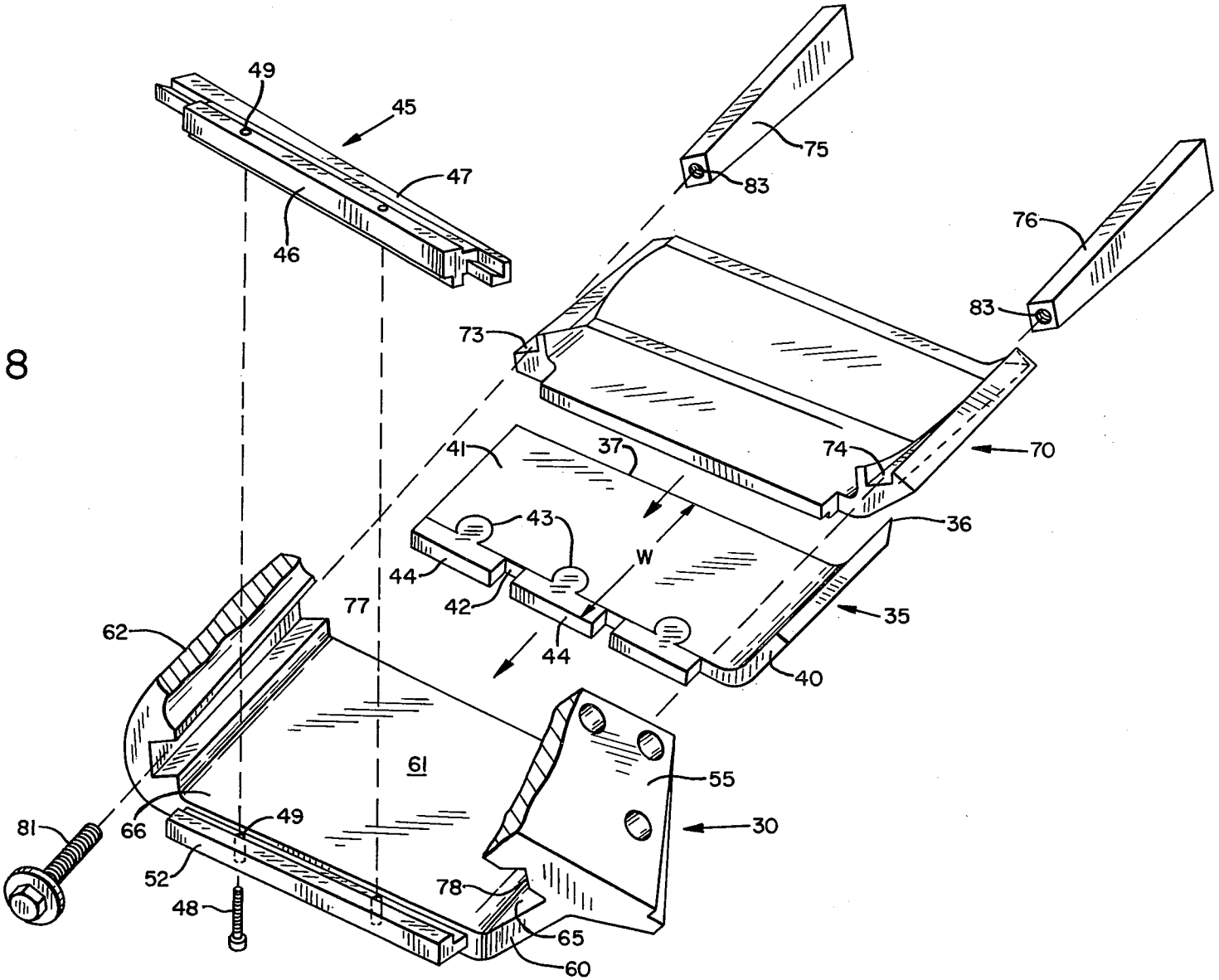
FIG. 8 is an exploded view of the parts with parts broken away.

Each knife holder 30 carries a knife 35. As shown in FIG. 8 the knife 35 comprises a bent blade having a sharpened planing edge portion 36 and a sharpened chip cutting edge portion 37. The planing edge portion 36 planes a smooth flat surface on the log while the chip cutting edge portion 37 cuts off chips on a conical surface as explained in said patent. Edge portion 37 is considerably longer than edge portion 36 and these two edge portions are disposed at an angle of approximately 125° relative to each other. Edge portion 36 is formed on a flat shank portion 40 and edge portion 37 is formed on a flat shank portion 41.

The back edge 42 of shank portion 41 is provided with a pluality of key hole slots 43 which are chamfered on one side. Babbitt blocks 44 are cast on back edge 42 and interlocked in chamfered keyhole slots 43. This provides a constant width W which is maintained throughout the life of the knife.

Each time the cutting edge 36, 37 is sharpened the babbitt material 44 is removed and the knife is placed in a jig for casting new babbitt blocks 44. After repeated sharpenings the knife becomes narrower and the babbitt material 44 increases in width to maintain the constant dimension W as shown in FIG. 8. This allows the knife to be resharpened many times before it is too narrow for further use since there are no deep slots to receive the usual clamp screws.

Figure 7:
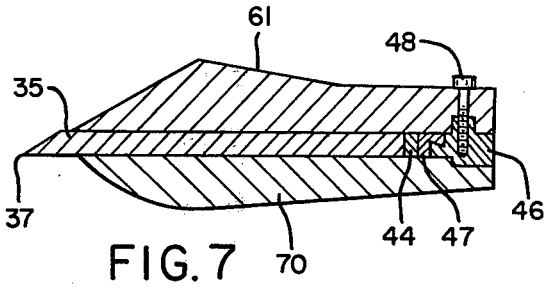
FIG. 7 is a view on the line 7—7 in FIG. 5.
Figure 4:
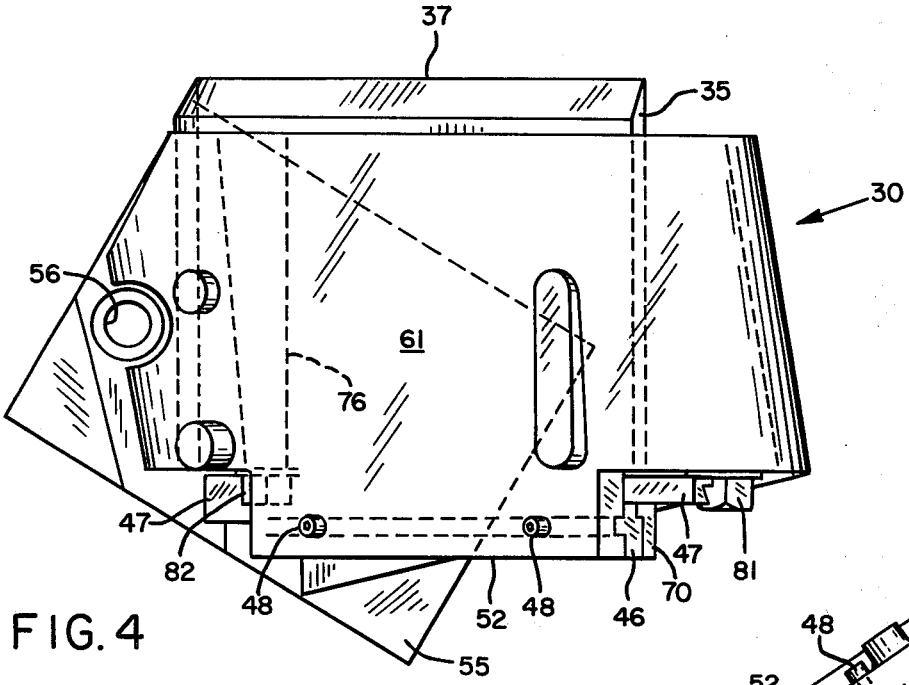
FIG. 4 is a top plan view of the knife holder.

As shown in FIGS. 7 and 8 a backing bar assembly 45 comprising a fixed bar 46 and a movable bar or wedge 47 is attached to knife holder 30 by screws 48 in screw holes 49 through bar 46 and a tongue or flange 52 on holder 30. Screws 48 also serve to clamp movable bar 47 in place after the bar is adjusted.

The two parts 46 and 47 are machined with an interlock on a taper, as shown, in such a way that when movable bar 47 is moved longitudinally the assembly including the knife increases or decreases in width to provide for knife adjustment. This is a permanent adjustment which is not changed when the knife is sharpened, additional pressure being exerted on the assembly when the knife is clamped in place as will presently be explained.

As seen in FIG. 2 each holder 30 has a flat base or mounting pad portion 55 with holes 56 to receive screws for mounting the holder on a flat side 57 of the rotor head 25. The mounting surfaces 57 appear FIG. 1. In the present illustration the rotor is octagonal with eight side surfaces 57 each lying in a plane parallel with rotor axis and each carrying one of the knife holders 30. Thus, the eight flat surfaces 57 are all perpendicular to the rotor end surface 58 in FIG. 1.

Figure 6:
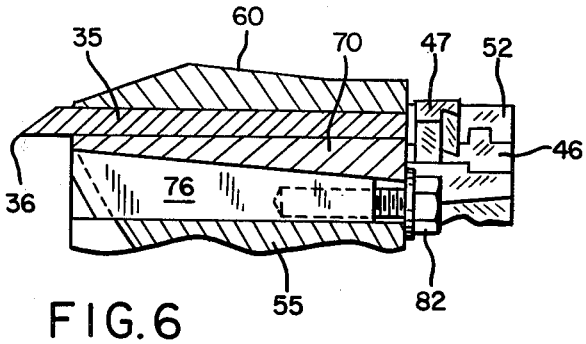
FIG. 6 is a view on the line 6—6 in FIG. 5.
Figure 5:
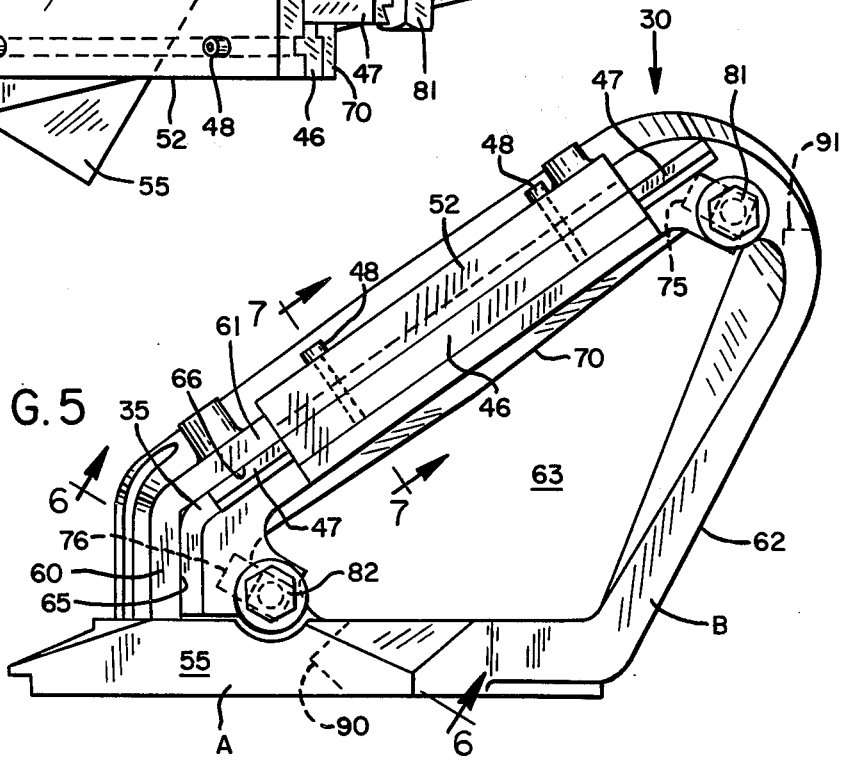
FIG. 5 is an elevation view of the knife holder.

Referring now to FIG. 5, each knife holder 30 has a short straight leg 60 perpendicular to base 55 and a long straight leg 61 disposed at an angle of approximately 125 degrees to leg 60. The outer end of leg 61 is supported by a curved back leg 62, the parts 55, 60, 61 and 62 forming an integral rigid member having a chip opening 63 extending therethrough. Leg portions 60 and 61 of the holder 30 have flat inside supporting surfaces 65 and 66 to receive and position the back faces of the knife shank portions 40 and 41 as also shown in FIGS. 6 and 7.

Figure 3:
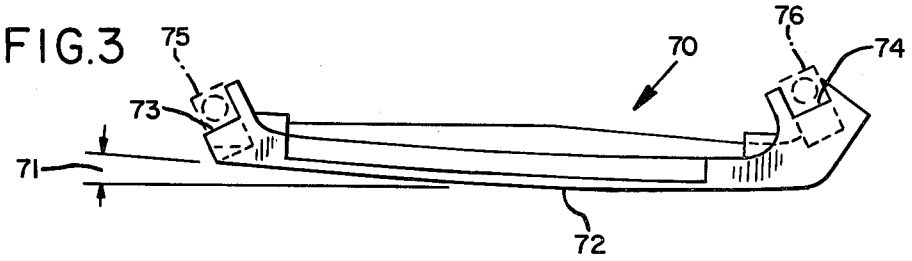
FIG. 3 is a back end view of the knife clamp plate showing the crown.

Clamp plate 70 in FIG. 8 is crowned or cambered in a transverse arch as indicated by the small angle 71 in FIG. 3. This produces a convex front face 72 on the clamp plate to bear against the back face of knife 35 and clamp the front face of the knife against the knife supporting surfaces 65 and 66 in knife holder 30 when the parts are assembled. Extending along the opposite side edges on the back face of clamp plate 70 are a pair of wedging surfaces 73 and 74 which are slidably engaged by a pair of wedges 75 and 76.

The wedges 75 and 76 are slidable in a pair of grooves 77 and 78 in knife holder 30. The wedges are individually tightened by a pair of screws 81 and 82 having threaded engagement with screw holes 83 in the small ends of the wedges, the heads of the screws bearing against the end surface of knife holder 30. Tightening the screws 81 and 82 thus flattens the arched clamp plate 70 against the back face of knife 35 to clamp the knife securely against the supporting surface 65 and 66 in the knife holder. The knife is removed by loosening screws 81 and 82 to give about ¼ inch of slack and then rapping the screw heads to drive the wedges into loosened positions. The wedge taper is of appropriate angle to facilitate this mode of operation.

A preferred tightening sequence is to first pull up the wedge 76 snugly at the bend side of the knife, then tighten the wedge 75 at the opposite side of the clamp plate and then finally tightening the wedge 76. Clamp plate 70 is positioned against the shoulder on fixed bar 46 which is seated in the groove in flange 52 on holder 30, which flange is attached to the backing bar 46. This arrangement in effect permits positioning of the clamp plate 70 every time the side wedges 75 and 76 are tightened. Setting the inner wedge 76 first tends to position the planing portion of the knife which relates directly to the smoothness of the board surface.

As previously described, the backing bar assembly 45 comprises the two sections 46 and 47 so that the wedge section 47 can be jacked forward or retracted as required for setting the knife. In practice, the movable portion 47 of the backing bar is first retracted, the knife is inserted and clamped to a moderate degree with the tightening screws 81 and 82. The knife is then moved out to the proper indicator reading which is just slightly beyond the end surface (face plate). The tightening screws are then fully tightened to bring the clamp plate into solid contact with the knife.

Knife holder 30 is made in two sections A and B as indicated by weld lines 90 and 91 in FIGS. 2 and 5. Machining of knife holder is done partially on the one section A after which the two sections are welded together or retained as a two piece part.

What is claimed is:

1. A knife holder for a woodworking knife comprising a support member having a surface arranged to support one face of the knife, a resilient cambered clamp plate in permanent, precise fixed position having a convex face confronting the opposite face of the knife, a pair of sliding wedges in said support member engaging the opposite face of said clamp plate along opposite side edge portions thereof to flatten the clamp plate against said knife and clamp the knife against said supporting surface, a longitudinal adjusting screw in each of said wedges having screw threaded engagement in the small end of the wedge and having a head end bearing on said support member to tighten the wedge, said screw heads being accessible for rapping on the screw heads to drive the wedges to loosened positions when the screws have been unscrewed a short distance in the wedges, a transverse backing bar secured in fixed position by screws in said support member, and means to position said knife in working position in said support member comprising a transverse wedge slidable between said backing bar and the back end of the knife, said backing bar clamping said transverse wedge in adjusted position against said support member when said backing bar screws are tightened, said backing bar abutting the back end of said clamp plate to position the clamp plate in said permanent, precise fixed position.

* * * * *